US005547051A

United States Patent [19]

Bartscht et al.

[11] Patent Number: 5,547,051

[45] Date of Patent: Aug. 20, 1996

[54] PROTECTIVE LUGGAGE TOTE BAG AND METHOD

[76] Inventors: Martin D. Bartscht, 1125 Canterbury Ct., Dallas, Tex. 75208; Morgan S. Gibbens, 2540 Elm St., Dallas, Tex. 75226

[21] Appl. No.: 196,313

[22] Filed: Feb. 15, 1994

[51] Int. Cl.[6] ..... A45C 3/08; A45C 13/00; A45C 13/26

[52] U.S. Cl. ..... 190/26; 190/103; 190/115; 150/105; 150/108; 150/154; 383/18

[58] Field of Search ..... 190/26, 103, 105, 190/115, 116, 127, 900, 901, 27; 383/18; 150/154, 105, 108

[56] References Cited

U.S. PATENT DOCUMENTS

| | | | |
|---|---|---|---|
| 179,745 | 7/1876 | Blake | 383/18 X |
| D. 235,691 | 3/1975 | Barad | 150/108 X |
| 2,324,495 | 7/1943 | Deming | 190/26 X |
| 2,432,001 | 12/1947 | Fisler | 150/108 X |
| 2,432,365 | 12/1947 | Allen | 150/154 X |
| 2,436,237 | 2/1948 | Brandt | 150/154 |
| 2,711,234 | 6/1955 | Rubens | 190/26 |
| 2,724,467 | 11/1955 | Jaffe | 190/26 |
| 2,732,046 | 1/1956 | Smallberg | 190/26 |
| 3,901,360 | 8/1975 | Cook | 190/26 |
| 4,657,135 | 4/1985 | Kjose | 190/26 X |
| 4,796,735 | 1/1989 | Horiuchi | 190/116 X |
| 4,810,102 | 3/1989 | Norton | 150/108 X |
| 4,913,074 | 4/1990 | Saliba | 190/127 X |
| 4,919,240 | 4/1990 | Tobias | 150/108 X |
| 4,953,674 | 9/1990 | Landes | 190/108 |
| 5,083,644 | 1/1992 | Collins, III | 190/26 |
| 5,107,971 | 4/1992 | Freeman | 190/26 |
| 5,172,795 | 12/1992 | Riceman | 190/26 |

FOREIGN PATENT DOCUMENTS

| | | | |
|---|---|---|---|
| 1038915 | 10/1953 | France | 150/154 |
| 180835 | 7/1956 | Switzerland | 150/154 |
| 229094 | 2/1925 | United Kingdom | 150/159 |
| 2167656 | 6/1986 | United Kingdom | 190/26 |

*Primary Examiner*—Sue A. Weaver
*Attorney, Agent, or Firm*—John W. Montgomery; Ross, Clapp, Korn & Montgomery, L.L.P.

[57] ABSTRACT

A protective tote bag is for covering and carrying a briefcase of the type having a handle at the top and having a length, a height and a width defining a rectangular shape. The protective tote bag includes an enclosure which is formed of a protective fabric material and having two closed sides, two closed ends and a closed bottom defining a rectangular shape sufficiently large for accommodating the briefcase to be covered and with a closable opening along a top edge thereof. A support strap having a width corresponding to a minimum width of the briefcase to be covered is securely fastened as through stitching and along two ends extending around the bottom of the enclosure. A shoulder strap is securely fastened to the support strap at each end of the enclosure so that it extends above the closable opening at the top edge of the enclosure to form a loop which has a sufficient length for supporting the tote bag over a human being's shoulder.

14 Claims, 3 Drawing Sheets

PROTECTIVE LUGGAGE TOTE BAG AND METHOD

TECHNICAL FIELD OF THE INVENTION

The present invention relates to a protective covering device by which normally hand-carried luggage can be shoulder carried, and in particular, a protective covering for a briefcase by which the briefcase can be shoulder carried.

BACKGROUND OF THE INVENTION

For many years, business travelers and professionals have been carrying briefcases in all types of weather conditions. Such cases are often made of expensive materials such as fine leather or other more exotic materials. Also increasingly, the business traveler, especially the air traveler, prefers not to check any luggage so that waiting time and the hassle of retrieving luggage from an overhead luggage and storage bin is reduced. The difficulty is that airports and the like public and private transportation facilities often have long walking distances to and from boarding gates. Hand carrying briefcases or other luggage over these distances can be cumbersome, tiring and awkward, particularly if other luggage is being carried. Also, ticket acquisition and presentation requires using one's hands and may require setting a briefcase down so that the possibility of theft or loss is increased.

Various protective coverings for luggage have been disclosed, including those disclosed in U.S. Pat. Nos. 2,711,234; 2,724,467; 2,732,046; 3,901,360; 4,953,674 and 5,107,971. Briefcase covers are specifically disclosed in U.S. Pat. Nos. 5,083,644 and 5,172,795. These previous devices are specifically designed to permit the handle to project through the covering. Currently, any disclosure or suggestion of a means for both protecting the briefcase and for facilitating carrying of the encased briefcase is unknown.

Some luggage is manufactured with shoulder straps, but U.S. Pat. No. 4,953,674 for a soft shell clothing satchel discloses a cover through which an existing shoulder strap on the satchel may be extended. There is no suggestion of attaching a shoulder strap to the cover itself. To the contrary, holes in the cover merely accommodate an existing shoulder strap. Another device as shown in U.S. Pat. No. 5,107,971 depicts a thin shoulder strap which is attached to a protective shell for luggage. Such a thin strap is imbued with drawbacks because it does not provide adequate support against tilting. Also, the bag is not provided with structural strength from a continuous support strap around the bottom of the bag.

It is noted that U.S. Pat. No. 2,711,234 depicts a means for snuggling a covering securely on the exterior surface of a briefcase. A tie string is used to draw the material closed to the handle, which remains exposed. In another U.S. Pat. No. 2,732,046, elastic bands are depicted, apparently for providing a snug fit to avoid a sloppy appearance. However, no effective stabilizing support is provided or suggested. There is no prior design which allows stable non-tilting shoulder carrying capabilities. There is no suggestion of stabilizing a tote bag for a piece of luggage or briefcase from a shoulder strap and which support is from a leveraged upper position so that awkwardness due to tilting is substantially reduced.

SUMMARY OF THE INVENTION

Thus, it is an object of the present invention to provide a protective covering for luggage by which the luggage can be easily and stably carried. The inventive luggage tote bag includes a bag sized for enclosing a piece of luggage without excessive clearance space so that the piece of luggage is stably held and enclosed within the protective bag. The bag is constructed of a durable yet flexible material. The bag is conveniently openable and closeable with a zippered opening. A shoulder support strap is attached to the bag forming a loop of sufficient length for shoulder carrying the tote bag with the luggage protectively held therein, advantageously providing hands-free carrying of the piece of luggage while simultaneously protecting the exterior of the luggage.

It is also an object of the invention to provide a protective tote bag having a support strap extending entirely around the sides and bottom of the tote bag. The support strap is connected with the shoulder strap so that the tote bag is strengthened in its carrying capacity. In this manner, the luggage tote is adapted for carrying potentially heavy pieces of luggage, such as briefcases, similar-sized products and the like, in which a substantial number of files and documents may be enclosed.

It is another object of the invention to provide a support strap extending around the sides and bottom of the luggage enclosing tote bag, and which support strap has a substantial width, so that lateral support is provided to the enclosed luggage, so that it remains in an upright stable position when carried from the user's shoulder. Preferably, the shoulder strap which is connected to the support strap has a width corresponding to the width of the support strap thereby further stabilizing the luggage. Further preferably, the shoulder strap is integrally formed with the support strap, thereby reducing instability which might result from connective joints and further reducing the cost of manufacture of the advantageous tote bag.

It is a further object of the invention to provide a tote bag having a continuous support strap extending around the lower perimeter, a shoulder strap integrally formed with the support strap forming an adjustable length loop thereabove, and tote bag slack adjusting straps extending from the support strap near the top of the piece of luggage on either end thereof. The slack adjusting straps are used to simultaneously pull the tote bag fabric taut to avoid undesirable flapping and the like and to further secure the luggage therein in a stable upright position with respect to the support strap and the shoulder strap extending therefrom.

It is another further object of the invention to provide a cost-effective method of constructing a tote bag. The method includes cutting a blank from water-resistant fabric sheet material, folding the blank to form a bottom and joining end portion of the blank to form closed ends of a rectangular shaped enclosure or cover. Sewing a reversibly openable and closeable zipper along a top edge. Sewing a continuous support strap with sufficient length for forming a shoulder loop. Providing adjustable shoulder strap buckle and sewing adjuster straps at each end provide for multiple side adjustment and stabilization tightening.

The foregoing objects and advantages are provided with a luggage tote bag, and specifically a briefcase tote bag which includes a specific shape (unique among ordinary tote bags) for enclosing small luggage or standard size briefcases. A shoulder strap is attached which is sufficiently long to extend over a user's shoulder. The length of the strap is adjustable to allow comfortable shoulder carrying of the luggage or briefcase as opposed to hand carrying. Further, the shoulder strap is made of strong belt material, such as woven nylon or woven cotton, which preferably extends entirely around the bottom of the tote bag so that adequate structural support is provided. Also, the width of the shoulder strap, where it traverses along the ends and bottom of the tote bag, is nearly as wide as the luggage or briefcase so that tilting support is further provided.

The tote bag is also constructed sufficiently wider than the small luggage or briefcase which is to be protectively enclosed. Adjustable end straps are used to take up any slack in the tote bag material so that the briefcase or other luggage item is securely supported. The adjustable end straps are preferably attached to the shoulder strap near the top of the tote bag and extend on either side of the shoulder strap to prevent tilting, wobbling and sliding of the piece of luggage within the tote bag while allowing easy entry into the tote bag.

BRIEF DESCRIPTION OF THE DRAWINGS

These and other objects and advantages will be more fully understood with reference to the following dètailed description, claims and drawings, in which like numerals represent like elements and in which:

DETAILED DESCRIPTION OF THE PREFERRED EMBODIMENTS

Figure 1:
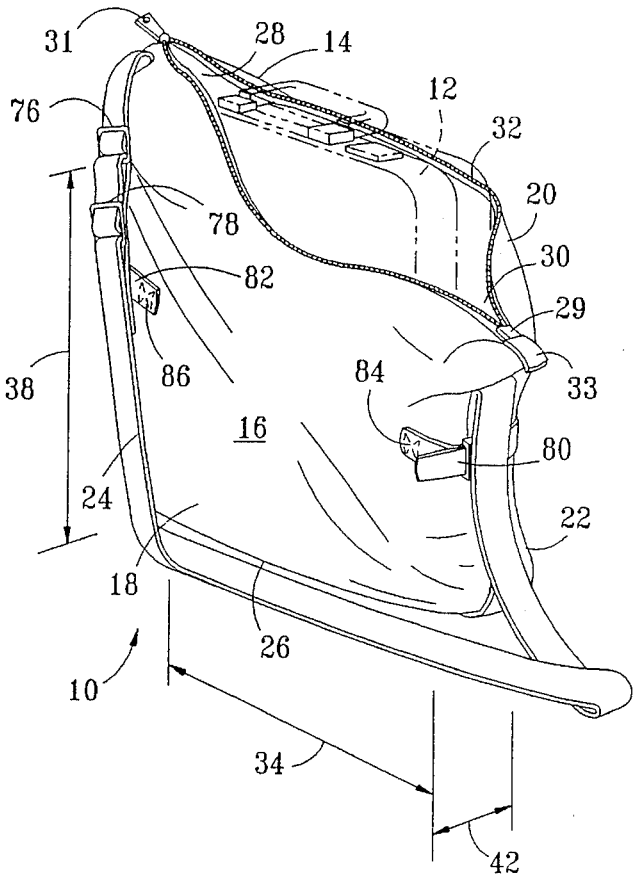
FIG. 1 is a perspective view of the inventive tote bag according to the present invention.

FIG. 1 is a perspective view of the inventive tote bag 10 according to the present invention shown in an open condition with a briefcase to be covered or a small rectangular piece of luggage 12 positioned partially within an enclosure 14. The enclosure 14 is composed of a fabric material, preferably a mar-resistant fabric and more preferably, a moisture-resistant fabric, to provide protection to the exterior of the briefcase. Enclosure 14 is formed with a first side 18, a second side 20, a first end 22, a second end 24, and a closed bottom 26. The sides, end and bottom can be connected together as with bonding or stitching to form a rectangular interior 28 and a closable opening 30. The closable opening 30 is formed along the top edge 32 of the enclosure. The opening is made reversibly closable and openable, as with a zipper 29 and a movable slide mechanism 31 and conveniently a holding tab 33 is at least one end thereof to allow easy pulling of the slide mechanism 31.

Figure 3:
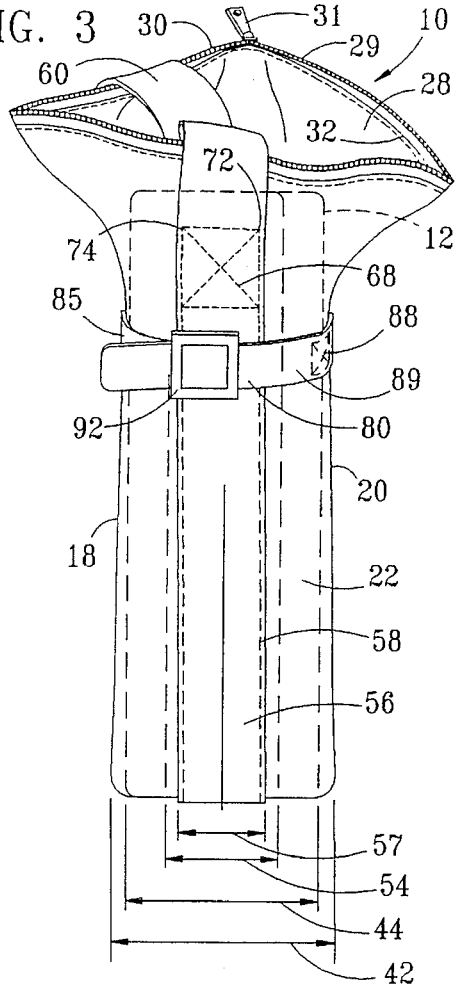
FIG. 3 is an end perspective view with a briefcase shown in phantom lines.
Figure 2:
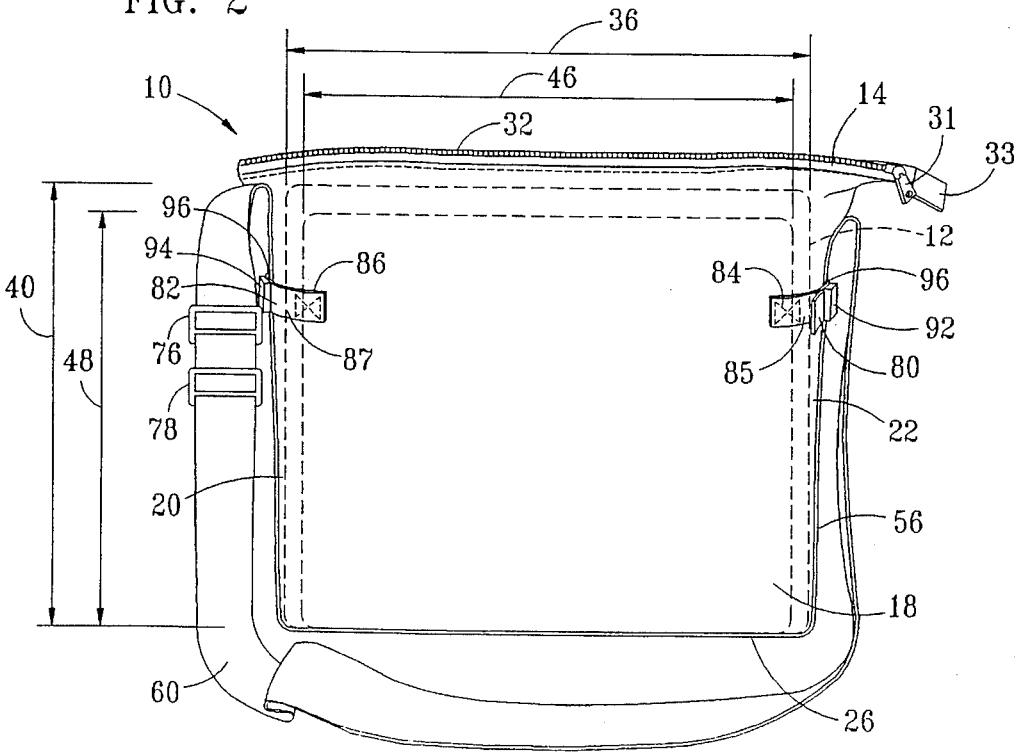
FIG. 2 is a side elevation view of the tote bag of FIG. 1.

With reference to FIGS. 1, 2 and 3, in which FIG. 2 shows a side view of the tote bag and FIG. 3 shows an end view with a briefcase enclosed therein shown in phantom lines. The length 34 of the tote bag's sides 18 and 20 from end 22 to end 24 is sufficiently long to accommodate the maximum length 36 of a briefcase (as shown in FIG. 2). Also, the height 38 of the tote bag is sufficiently high to accommodate the maximum height 40 of the briefcase as shown in FIG. 2. Similarly, the width 42 of the tote bag enclosure 14 is sufficiently wide to accommodate the maximum width 44 of the briefcase to be covered (as shown in FIG. 3.)

The tote bag is preferably formed so that its size substantially corresponds to one of various standard sizes for briefcases. Several different toe bag sizes can be made to closely fit any piece of luggage or briefcase. However, uniquely the construction of the tote bag uniquely allows a single size tote bag to be used with briefcases or small luggage of many different sizes. Thus, for example, one size tote bag can be used for many smaller briefcases having overall dimensions less than the maximum briefcase length 36 corresponding to the length 34 of the tote bag, the maximum briefcase height 40 corresponding to the maximum height 38 of the tote bag and the maximum briefcase width 44 corresponding to the maximum width 42 of the tote bag. Thus, for example, a briefcase having a minimum length 46 and a minimum height 48 (as shown in FIG. 2) is uniquely accommodated using adjusters 80 and 82, the construction and operation of which adjusters 80 and 82 will be explained more fully below.

For many manufacturers, the briefcase length and height are standardized within a range of about 13–14 inches high and about 17–18 inches long in order to accommodate within the interior of the briefcase standard legal size file folders. This briefcase size gives about 2–3 inches top and end clearance for legal files, which are typically about 15 inches long and about 10 inches high. Typically, the customer selects a briefcase by its width, which determines the capacity. Expensive briefcases are most typically between 2 inches and 5 inches wide and in some cases wider. Advantageously, adjusters 80 and 82 can uniquely be used to accommodate a range of briefcase widths. Preferably, different tote bags can be constructed having particular width dimensions corresponding to the various incremental widths and sizes of briefcases, as for example, a 2 inch wide model, a 3 inch wide model, a 4 inch wide model and a 5 inch wide model. Thus, a 2 inch tote bag may be designed for a particular sized luggage or briefcase. Still, there are variations within these "standard" dimensions for which the adjusters are advantageous.

Figure 4:
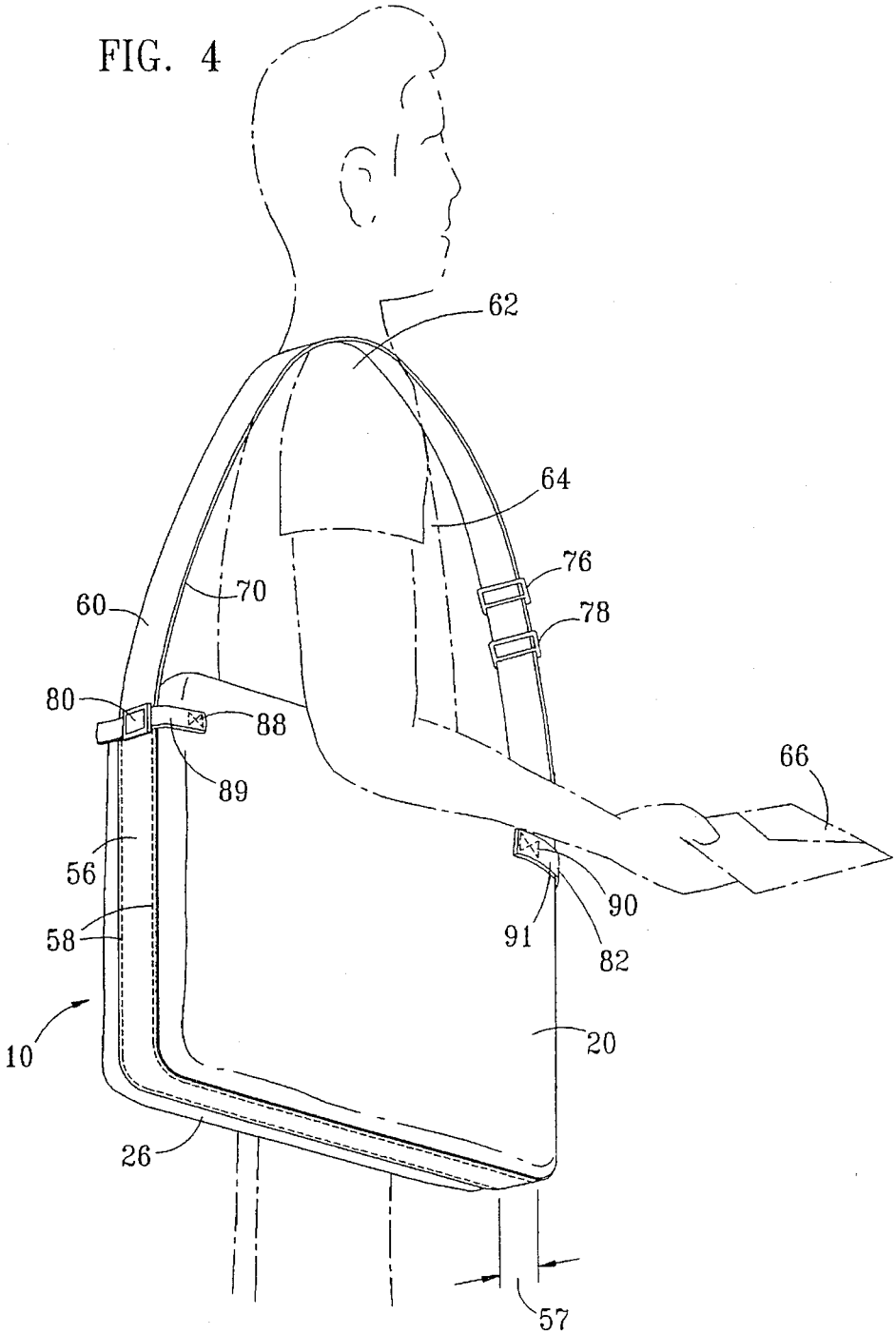
FIG. 4 is a perspective view of the tote bag of FIG. 1 in use on a person's shoulder.

The tote bag is constructed with a support strap 56 which is attached to the fabric 16 of enclosure 14 as with stitching 58. The support strap advantageously extends entirely along first end 20 around bottom 26 and back up along second end 24 and serves to provide mechanical strength to enclosure 14 for carrying the weight of a briefcase 12. The support strap 56 is attached to a shoulder strap 60 so that the enclosed and protected briefcase 12 can be conveniently suspended from a shoulder 62 on a user 64, shown in phantom lines in FIG. 4. This allows hand-free carrying of the briefcase which is beneficial in many situations. For example, when travelling, items 66, such as tickets or other items, such as credit cards, coats, purses or other things can be easily carried and accessed as shown in FIG. 4.

The shoulder strap 60 may be attached to the support strap 56 using various alternative methods, which for example, may be through stitching 68 as shown in FIG. 3 or other means of physical attachment. In a preferred alternative embodiment, the shoulder strap 60 is integrally formed with the support strap 56 so that separate stitching 68 is not required in order to form a substantially continuous loop 70 which extends over the wearer's shoulder 62. In either alternative, the shoulder strap 60 is preferably attached (through stitching or through continuous weave or otherwise) at at least two separated points on the width 57 of the support strap 56 as for example, at points 72 and 74 as shown in FIG. 3. This provides mechanical leverage by which tilting of the briefcase is resisted.

The width 57 of the support strap is substantially equal to or slightly less than the minimum width 54 of standard size briefcases. Thus, in a preferred embodiment, the support strap 56 will be constructed to a strap having a width of between about 1½ to about 2½ inches and a thickness of between about 1/32 to about 1/8 inch. For example, the nylon belts, such as those used as standard seatbelt material and which are about 2 inches wide and about 1/16 inch thick, can be conveniently fashioned into a support strap 56, and also the shoulder strap can be constructed of substantially the same material or the same continuous strap. Other woven material belts or straps which resist crushing, such as woven cotton and the like, can also be used. The continuous loop 70 is preferably adjustable as with adjustment buckles 76 and 78 to allow adjustment to a convenient size for carrying by the user. Once the size is adjusted for a particular briefcase and user, it need not be readjusted unless the user desires to do so.

To further provide stability to a briefcase 12 when it is enclosed within enclosure 14, and also to uniquely provide size adjustment capabilities, adjusters 80 and 82 are provided at each end 22 and 24 of the enclosure 14.

Adjuster 80 is attached to side 18 as at stitching 84 and adjuster 82 is attached to side 18 at stitching 86 as shown in FIG. 2. Adjuster 80 is attached to side 20 at stitching 88 and adjuster 82 is attached to side 20 at stitching 90. Adjusters 80 and 82 are each provided with adjustable connectors 92 and 94, respectively. The adjusters 80 and 82 may, for example, be constructed of first and second strap portions 85 and 89 for adjuster 80 and first and second strap portions 87 and 91 for adjuster 82. The separate strap portions are connected with buckles 92 and 94, respectively. Preferably, adjustment of the tightness of the adjusters 80 and 82 and thus taking slack out of the fabric 16 of enclosure 14 is toward the top of the tote bag and toward the top of the briefcase 12. A greater proportion of the briefcase 12 is below the adjusters than is above the adjusters. Stability of the briefcase is therefore facilitated. Essentially, the weight of the briefcase is suspended from the shoulder strap 60 and the weight is carried through support strap 56. Vertical tension in the support strap 56 keeps it stretched taut so that horizontal force, applied through adjusters 80 and 82, and to the briefcase 12, prevents it from tilting when enclosed within enclosure 14. In an alternative embodiment, adjusters 80 and 82 can be secured directly to support strap 56 as with mating hook-and-loop materials 96 positioned and between support strap 56 and the adjusters 80 and 82. For example, one portion of the hook-and-loop material 96 is attached directly to support strap 56 and another portion is attached to the buckles 92 and 94.

Figure 5:
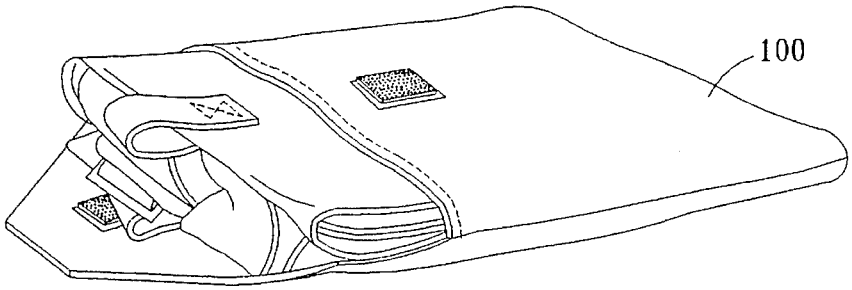
FIG. 5 is a perspective view of the tote bag folded and stored in a carrying pouch.

As shown in FIG. 5, the tote bag can be conveniently folded and stored within a carrying case 100. The carrying case 100 is sufficiently small when the tote bag is appropriately folded and inserted, so that it may be placed within a briefcase when the tote bag is not being used.

Figure 6:
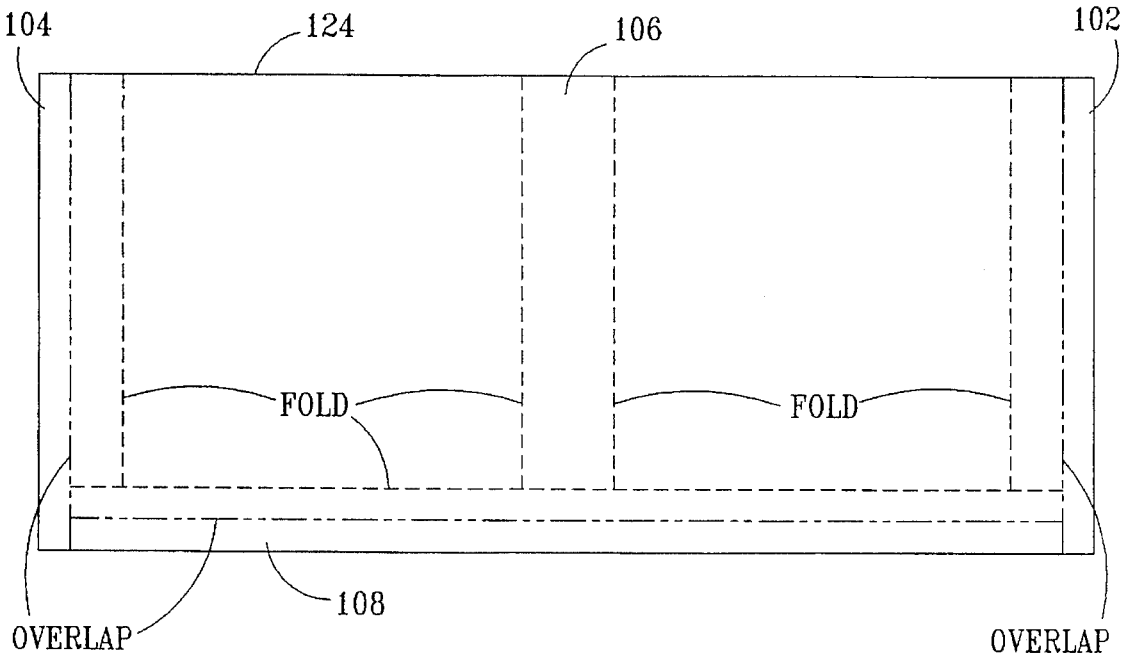
FIG. 6 is a top plan view of a blank cut from a single sheet of fabric for the construction of a tote bag according to the present invention.
Figure 7:
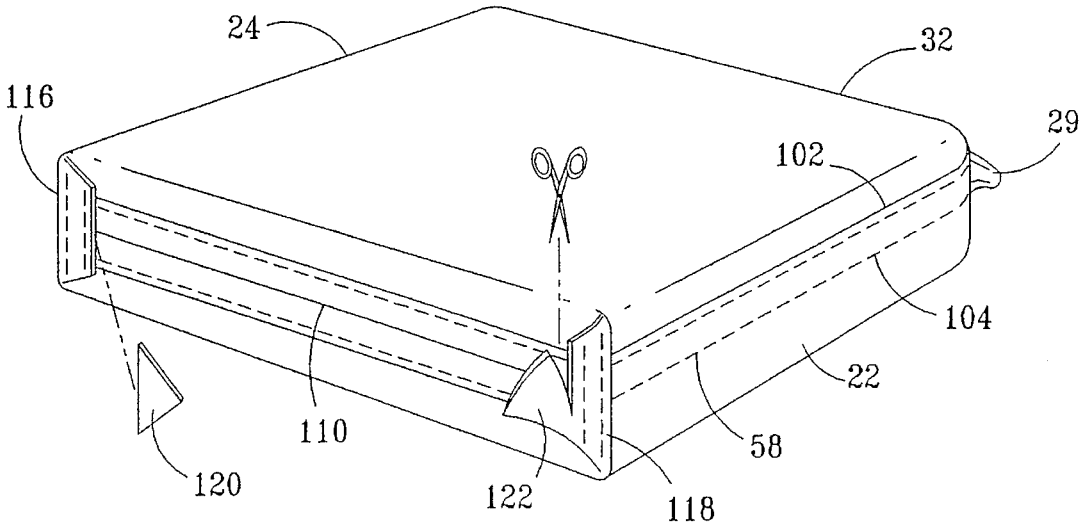
FIG. 7 is a tote bag enclosure 14 shown turned inside out so that its construction can be observed.

With reference to FIGS. 6 and 7, the method of construction of the inventive tote bag, from a single sheet of fabric 16, is shown. FIG. 6 shows a top plan view of a rectangular blank cut from a single sheet of fabric which will, upon folding, sewing and trimming, form the tote bag. Opposite ends 102 and 104 will be overlapped and sewn together to form one end 22 of tote bag 10, as shown in FIG. 7. A middle portion 106 will form another end 24. The bottom edge portion 108 will then be folded to overlap itself and sewn along a longitudinal seam 110 and along two perpendicular seams 112 and 114 to form corners 116 and 118. Excess corner flaps 120 and 122 will then be cut off and trimmed as with a non-ravelling stitch. The top edge portion 124 will form top edge 32, and a closable opening will remain therealong. The bag will then be turned inside out to present a smooth exterior appearance. The support strap 56 will be sewn along the ends and bottom as with stitch lines 58.

A continuous strap of material will be sewn along end 22, bottom 26 and opposite end 24 to form an attached support strap 56, and preferably support strap 56 will extend upward above the tote bag with shoulder strap to form a continuous loop 70 for carrying the tote bag. Adjustable buckles 76 and 78 will secure opposite ends and will be used on the shoulder strap 60 in order to provide adjustable length. Further, adjusters 80 and 82 will be attached as with stitches 84 and 88 and 86 and 90. A zipper 29 will be attached along top edge 32 which corresponds to edge 124 in FIG. 6.

Thus, what has been disclosed is a protective tote bag for covering and carrying a briefcase with the entire briefcase including the handle enclosed. The tote bag has a support strap along the ends and around the bottom of the bag to provide mechanical support to the enclosed briefcase so that stretching of the protective fabric is reduced thereby extending the life of the tote bag. Further, the support strap is sufficiently wide and is attached to a shoulder strap so that tilting support is provided to thereby facilitate ease of operation of the tote bag for hand-free carrying of the briefcase while protecting an expensive briefcase exterior, such as leather or other expensive materials from the elements and from marring, scraping and rubbing wear and tear.

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

What is claimed is:

1. A protective tote bag for covering and carrying a briefcase of the type having a handle at the top and having a length, a height and a width defining a rectangular shape, said protective tote bag comprising:

(a) an enclosure formed of a protective fabric material and having two closed sides, two closed ends and a closed bottom defining an interior which has a length, height and width defining a rectangular shape sufficiently large for accommodating said briefcase to be covered and having a closable opening and closing mechanism along a top edge thereof;

(b) a support strap having a width equal to a minimum width of the briefcase to be covered, which strap is securely fastened along said two ends, and extending around said bottom of said enclosure; and (c) a shoulder strap securely fastened to said support strap at each end of said enclosure and extending above said closable opening at said top edge of said enclosure forming a loop, which loop has a length sufficient for supporting said tote bag over a human being's shoulder.

2. The protective tote bag of claim 1 wherein:

(a) said shoulder strap and said support strap are of substantially equal width; and (b) said fastening of said shoulder strap to said support strap is in at least two spaced apart places along said equal width of said shoulder strap and said support strap, at both ends of said enclosure so that said support strap provides upward support to the enclosed briefcase and also provides support against tilting relative to said shoulder strap.

3. The protective tote bag of claim 2 wherein said shoulder strap and said support strap comprise a single continuous strap extending around said ends and bottom of said enclosure with portions thereof projecting above said top edge of said enclosure and attached to itself so that said shoulder strap loop is formed.

4. The protective tote bag of claim 3 wherein said shoulder strap loop further comprises an adjustable clasp so that said length of said loop can be adjusted to a desired length for comfortable shoulder-supported carrying of said briefcase enclosed within said tote bag.

5. The protective tote bag of claim 3 wherein said continuous shoulder strap comprises a woven belt material having a thickness between about 1/32 and 1/8 of an inch and a width of approximately 1½ inches.

6. The tote bag of claim 1 further comprising means for adjusting the size of said enclosure attached between said two closed sides of said protective fabric material, and also movably attached to said support strap adjacent to said top edge of said enclosure, such that support to said fabric material and to the top of the enclosed briefcase is thereby provided from said shoulder strap to said support strap, and from said support strap to said means for adjusting the size of said enclosure, and from said means for adjusting to said protective fabric material at said top edge of said tote bag, thereby supporting the enclosed briefcase against tilting.

7. The tote bag of claim 1 wherein said protective fabric material of said enclosure comprises a mar-resistant material.

8. The tote bag of claim 1 wherein said protective fabric material of said enclosure comprises a moisture-resistant material.

9. A protective tote bag for covering and carrying a briefcase of the type having a handle at the top and having a length, a height and a width defining a rectangular shape, said protective tote bag comprising:

(a) an enclosure formed of a protective fabric material and having two closed sides, two closed ends and a closed bottom defining an interior which has a length, height and width defining a rectangular shape sufficiently large for accommodating said briefcase to be covered and having a closable opening and closing mechanism along a top edge thereof;

(b) a single continuous strap, having a shoulder strap portion and a support strap portion, said support strap portion securely fastened along said ends and extending along said bottom of said enclosure, and said shoulder strap portion projecting above said top edge of said enclosure and attached to itself, forming a shoulder strap loop, which shoulder strap loop has a length sufficient for supporting said tote bag over a human being's shoulder; and (c) means for adjusting the size of said enclosure attached to said two closed sides of said protective fabric material and overlaying said support strap portion of said single continuous strap at both ends of the enclosure, each means for adjusting the size of the enclosure being adjustable so that any looseness in said protective fabric material when said briefcase is enclosed, is taken up and so that support at the top of the briefcase is provided through said means for adjusting the size and from said support strap which it overlays.

10. A protective tote bag for covering and carrying a briefcase of the type having a handle at the top of the briefcase and having a length, a height and a width defining a rectangular shape of the briefcase, said protective tote bag comprising:

(a) an enclosure formed of a protective fabric material and having two closed sides, two closed ends and a closed bottom defining an interior which has a length, height and width defining a rectangular shape sufficiently large for accommodating said briefcase to be covered and having an opening with a closable mechanism attached at the opening along a top edge thereof;

(b) a support strap having a width, which width is in a range of about ½ inches to about ½ inches and which support strap is securely fastened along said two ends and extending around said bottom of said enclosure; and (c) a shoulder strap having a width, which width is substantially equal to said width of said support strap and which shoulder strap is securely fastened to said support strap at each end of said enclosure in at least two spaced-apart places along said equal width of said shoulder strap and said support strap, so that said support strap provides upward support to the enclosed briefcase and also provides support against tilting relative to said shoulder strap, and which shoulder strap extends above said closable opening at said top edge of said enclosure, thereby forming a loop, which loop has a length sufficient for supporting said tote bag over a human being's shoulder.

11. The protective tote bag of claim 10, wherein said shoulder strap and said support strap comprise a single continuous strap extending around said ends and bottom of said enclosure, with portions thereof projecting above said top edge of said enclosure and attached to itself so that said shoulder strap loop is formed.

12. The protective tote bag of claim 10, wherein said shoulder strap and said support strap comprise woven belt material having a thickness between about 1/32 inch and 1/8 inch and a width of approximately 2 inches.

13. The protective tote bag of claim 10, wherein said protective fabric comprises a mar-resistant fabric and further comprising:

(a) a pair of size adjusters, each including first and second adjuster straps and an adjustable connector therebetween, each first and second adjuster strap attached to opposite sides of said enclosure, each one of said pair of adjusters at opposite ends of said enclosure and overlaying said support strap, such that each first and second adjuster straps, and said connector therebetween, are adjustable so that looseness in said protective fabric, when the briefcase is enclosed, can be taken up, thereby providing support at the top of the enclosed briefcase from said support strap.

14. The protective tote bag of claim 13 further comprising means for attaching said first and second adjuster straps, and connectors therebetween, at each end of said enclosure to said support strap adjacent to said top edge of said enclosure, such that support to said protective fabric material and to the enclosed briefcase is provided from the shoulder strap to the support strap and through the first and second adjuster straps and adjustable connector therebetween at said top edge of said tote bag, thereby supporting the enclosed briefcase against tilting.

* * * * *

UNITED STATES PATENT AND TRADEMARK OFFICE

CERTIFICATE OF CORRECTION

PATENT NO. : 5,547,051

DATED : August 20, 1996

INVENTOR(S) : Martin D. Bartscht, et al.

It is certified that error appears in the above-identified patent and that said Letters Patent is hereby corrected as shown below:

Column 8, Line 11 --

Replace: ... of about ½ inches to about ½ inches and ...

With: ... of about 1½ inches to about 2½ inches and ...

Signed and Sealed this

Twenty-ninth Day of October 1996

*Attest:*

*Attesting Officer*

BRUCE LEHMAN

*Commissioner of Patents and Trademarks*